US008438891B2

(12) United States Patent
Vanderschueren et al.

(10) Patent No.: US 8,438,891 B2
(45) Date of Patent: May 14, 2013

(54) ROLLING MILL WITH COOLING DEVICE AND ROLLING PROCESS

(75) Inventors: Dirk Vanderschueren, Roosdaal (BE); Patrick Van Poecke, Zaffelare (BE)

(73) Assignee: ArcelorMittal France, Saint Denis (FR)

( * ) Notice: Subject to any disclaimer, the term of this patent is extended or adjusted under 35 U.S.C. 154(b) by 399 days.

(21) Appl. No.: 12/602,848

(22) PCT Filed: Jun. 2, 2008

(86) PCT No.: PCT/IB2008/001403
§ 371 (c)(1),
(2), (4) Date: Mar. 24, 2010

(87) PCT Pub. No.: WO2008/149195
PCT Pub. Date: Dec. 11, 2008

(65) Prior Publication Data

US 2010/0180657 A1 Jul. 22, 2010

(30) Foreign Application Priority Data

Jun. 4, 2007 (EP) ..... 07290689

(51) Int. Cl.
*B21B 27/06* (2006.01)

(52) U.S. Cl.
USPC ..... 72/201; 72/236; 72/342.2

(58) Field of Classification Search ..... 72/201, 72/236, 342.2, 342.3
See application file for complete search history.

(56) References Cited

U.S. PATENT DOCUMENTS 3,192,757 A * 7/1965 Diolot ..... 72/201
4,422,318 A * 12/1983 Christ et al. ..... 72/200
4,934,444 A * 6/1990 Frischknecht et al. ..... 164/480
5,046,347 A * 9/1991 Crosato et al. ..... 72/201
5,212,975 A * 5/1993 Ginzburg ..... 72/43
5,553,469 A * 9/1996 Seidel ..... 72/13.4
5,694,799 A * 12/1997 Wolpert et al. ..... 72/43
6,006,574 A 12/1999 Armenat et al.
6,385,989 B1 5/2002 Cassidy (Continued)

FOREIGN PATENT DOCUMENTS

CN 1436106 A 8/2003
CN 2659574 Y 12/2004

(Continued)

OTHER PUBLICATIONS

Office Action issued Apr. 10, 2012 in Japanese Patent Application No. 2010-510898 (with English-language translation).

(Continued)

*Primary Examiner* — Dana Ross
*Assistant Examiner* — Homer Boyer
(74) *Attorney, Agent, or Firm* — Davidson, Davidson & Kappel, LLC

(57) ABSTRACT

The invention deals with a rolling mill (1) for metallic products comprising at least one pair of work rolls and at least one cooling device (2) projecting a plurality of cooling jets under pressure on at least one work roll, the cooling device projecting also at least one scraper jet between the cooling jets and the metallic product to be rolled, the scraper jets being oriented in the desired flow direction following a re-entrant angle towards the perpendicular to the surface of the work roll, as well as with a rolling process using said rolling mill (1).

11 Claims, 1 Drawing Sheet

U.S. PATENT DOCUMENTS

Figure 1:
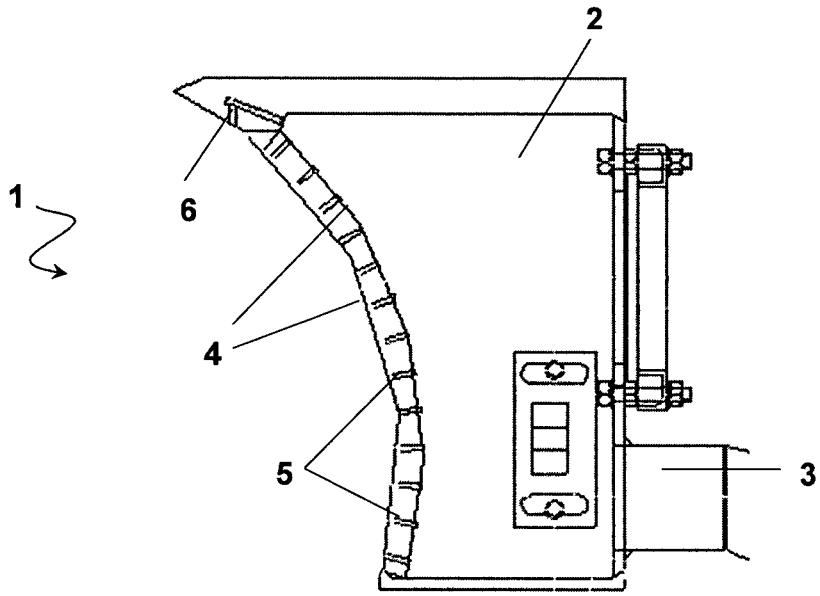

| | | | | |
|---|---|---|---|---|
| 6,499,328 | B2 * | 12/2002 | Faggiani et al. | 72/201 |
| 7,159,433 | B2 * | 1/2007 | Seidel | 72/201 |
| 7,266,984 | B2 * | 9/2007 | Cerv et al. | 72/236 |
| 7,523,631 | B2 * | 4/2009 | Fujibayashi et al. | 72/201 |
| 2001/0008181 | A1 * | 7/2001 | Anderson | 162/204 |

FOREIGN PATENT DOCUMENTS

| | | | |
|---|---|---|---|
| EP | 0 313 516 | | 4/1989 |
| EP | 0 899 030 | | 3/1999 |
| JP | 55 109508 | | 8/1980 |
| JP | 55-109508 | A | 8/1980 |
| JP | 60 231510 | | 11/1985 |
| JP | 2-133203 | U | 11/1990 |
| JP | 6-63615 | A | 3/1994 |
| JP | 10-5827 | A | 1/1998 |
| JP | 10-291011 | A | 11/1998 |

OTHER PUBLICATIONS

Office Action issued Nov. 12, 2010 in Chinese Patent Application No. 200880018739.8 (English-language translation only).

* cited by examiner

ROLLING MILL WITH COOLING DEVICE AND ROLLING PROCESS

CROSS-REFERENCE TO RELATED APPLICATIONS

This application is a National Phase of PCT/IB08/001403 filed Jun. 2, 2008 and claims the benefit of EP 07290689.4 filed Jun. 4, 2007.

The present invention deals with a rolling mill integrating a cooling device, which can be used for hot rolling of metallic products, like steel sheets, without being limited to such use and products.

Such a hot rolling consists in heating a metallic product and making it pass through pairs of rotating work rolls, so as to reduce the thickness of the heated metallic product under the pressure exerted by the top and the bottom work rolls.

The work rolls are heated through contact with the heated metallic products but also through their rolling action, and require to be cooled continuously, in the most uniform way. Cooling devices consisting in boxes drilled with a plurality of holes can be used to project a cooling fluid under pressure onto the work rolls during rolling.

In order to prevent that cooling fluid that is employed for roll cooling comes into contact with the metallic product that is being rolled, a mechanical scraper is being used. The mechanical scraper is a device which is in contact with the roll and mechanically blocks the flow of the cooling fluid. This scraper is closing the passage for the cooling fluid coming from the roll cooling device, avoiding the fluid to come into contact with the metallic product, which could be detrimental for said product.

However, such mechanical scraper undergoes a lot of thermal and mechanical constraints and must be very often replaced, imposing to interrupt the rolling production.

The purpose of the present invention is therefore to put at disposal a rolling mill with an improved cooling device, free of the above mentioned drawbacks, allowing an improved service life of said cooling device without production stops.

According to this, a first object of the present invention is a rolling mill for metallic products comprising at least one pair of work rolls and at least one cooling device projecting a plurality of cooling jets under pressure on at least one of said work roll, said cooling device projecting also at least one scraper jet between said cooling jets and the metallic product to be rolled, said scraper jets being oriented in the desired flow direction following a re-entrant angle towards the perpendicular to the surface of said work roll.

The rolling mill according to the invention can also comprise several other characteristics, alone or in combination, such as:

- the cooling jets are perpendicular to the surface of said work roll,
- the cooling jets are arranged in horizontal rows, each adjacent row being laterally shifted so as to form a quincunx disposition,
- the exits of said cooling jets are arranged along a curved surface, which curvature radius is higher than the radius of said work roll,
- the cooling device comprises a plurality of nozzles through which said cooling jets and scraper jets are projected on said work roll,
- the cooling device consists in a box fed with a cooling fluid under pressure, provided on one of its external surface with said cooling and scraper nozzles disposed on a curved plate,

- the cooling device is a water pillow cooling device including side guides for the formation of said water pillow,
- the cooled work roll can be a bottom work roll, and/or a top work roll,
- the rolling mill comprises at least two rolling stands, wherein said cooling device is implemented in the first and/or the second rolling stands, for example.

A second object of the invention is a cooling device as described above.

A third object of the present invention is a process of rolling metallic products using a rolling mill or a cooling device according to the invention, wherein said pressure of cooling and scraper jets is lower than 4 bar, preferably lower than 3 bar.

The process according to the invention can also comprise several other embodiments, taken alone or in combination, such as:

- the cooling fluid consists in water,
- the metallic product is a steel sheet,
- the rolling mill is a hot rolling mill.

Figure 2:
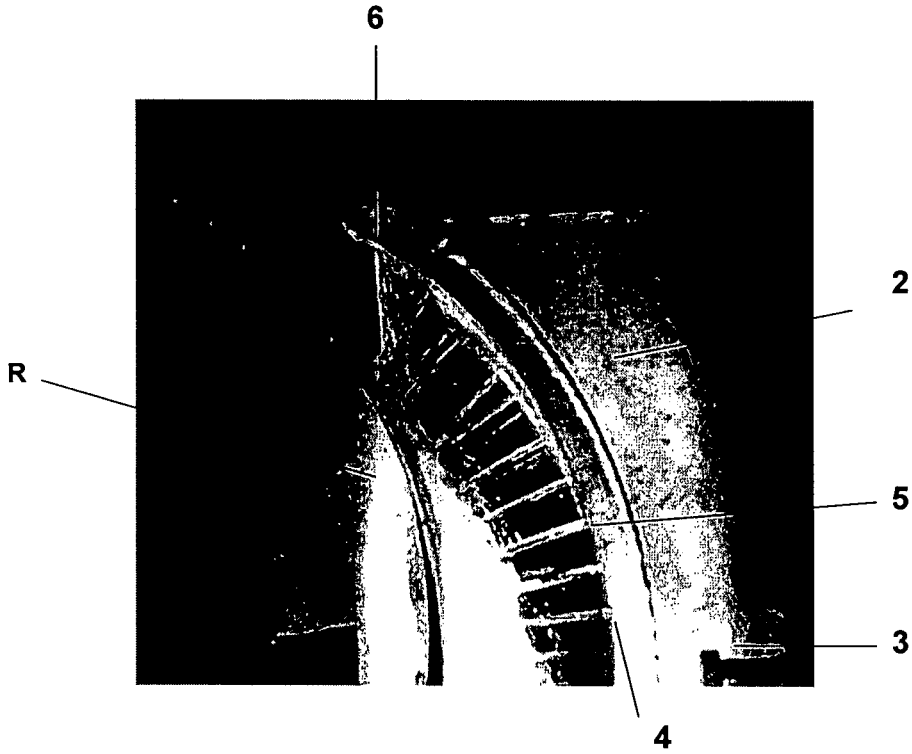

Other characteristics and advantages of the invention will appear through the detailed description which will follow, only given as a mere example and referring to the following figures:

FIG. 1: representing a sectional view of a cooling device according to the invention, FIG. 2: showing a picture of the cooling device of FIG. 1 during operation.

As can be seen on FIG. 1, a cooling device 1 according in the invention consists in a box 2 connected through a feeding pipe 3 to a cooling fluid container and to a pump (not represented). Said cooling fluid can, for example, be water or an emulsion of water and oil stabilised or not with surfactants.

Opposite to the fluid feeding pipe 3, the box 2 comprises a pair of curved plates 4 provided with a plurality of internal nozzles 5 forming and directing cooling fluid jets from the box 2 towards the roll surface. As can be better seen on FIG. 2, those nozzles 5 preferably have an orientation perpendicular to the work roll surface so as to cool it in a uniform way.

Above those cooling nozzles 5, scraper nozzles 6 are provided and connected to the inside of the box 2 which feeds them with cooling fluid under pressure. The orientation of those scraper nozzles 6 is different from the orientation of the cooling nozzles 5 and presents a re-entrant angle of approximately 45° towards the perpendicular to the work roll.

The operating pressure of the cooling is preferably under 4 bar and most preferably under 3 bar. Those pressures have proven to be sufficient to reach a good cooling action and help in limiting the bouncing of cooling fluid on the work roll surface.

The cooling nozzles 5 and the scraping nozzles 6 can have various section shapes and/or sizes. They are preferably disposed in parallel rows, each row being laterally shifted from the adjacent rows, so as to create a quincunx disposition. They can also be replaced by transversal slits extending along all or part of the cooling device, parallel to the ground, generating flat jets.

As can be better seen on FIG. 2, the scraper nozzles 6 guide the cooling fluid fluxes towards the ground, in the desired flow direction, tangentially to the roll R. They generate a kind of water curtain avoiding having any cooling fluid projection towards the metallic product to be rolled.

In the case where the scraper function would be applied to the top work roll, the scraper nozzles would, of course, guide the cooling fluid fluxes towards the top.

As can be seen on FIG. 2, the curved plates 4 have a higher curvature radius than the work roll radius, which is advantageous. The distance between the exit of the scraper nozzles 6 and the work roll R surface is determined in order to avoid any direct interaction between the scraper jets and the adjacent cooling jets so as not to reduce the cooling efficiency of the device. It is also important no to place the exit of the scraper jets to close to the work roll R surface to avoid any cooling fluid projection on the metallic product which would be due to the impact of the scraping jets themselves. As a matter of example, a distance under 20 mm has proven to be suited for a work roll diameter of 745 mm.

The design shown on FIG. 1 can of course be modified depending on the particular implementation to be performed. Thus, the external curved plate 4 can be omitted, which would let only the internal plate 4 provided with external protruding nozzles.

The curved plates 4 and internal nozzles 5 could also be replaced by a massive plate drilled with a plurality of through holes, playing the same role as the internal nozzles 5.

To improve the efficiency of the scraper action, the nozzles 6 or holes can have an increased density compared to the cooling nozzles 5. It is also of course possible to have more than one row of scraper jets placed at the top of the cooling device, to improve the scraper efficiency whenever required.

The cooling device with integrated scraper function according to the invention can be used to implement several types of cooling processes. Among those processes, it can advantageously be used to carry out a water pillow cooling process, where a water cushion is formed between the cooling device external surface and the roll through the use of side plates retaining the projected water.

Other processes are however suited to such a scraper function, like, for example, high turbulence roll cooling.

This cooling device can be installed on any rolling stands that needs to be efficiently cooled, but is preferably installed on the first rolling and/or second stands where the processing conditions are the most difficult.

It has been described for implementation on a bottom work roll but could also be implemented for a top work roll or both bottom and top work rolls at the same time.

The metallic products which can be processed by the rolling mill according to the invention are of various kinds. Steel products, like carbon steels or stainless steel, can be cited, together with ferrous alloys or aluminium products.

The invention claimed is:

1. A rolling mill for metallic products comprising at least one pair of work rolls and at least one cooling device projecting a plurality of cooling jets under pressure on at least one of said work roll, said cooling device projecting also at least one scraper jet between said cooling fluid jets and the metallic product to be rolled, said scraper fluid jet being oriented in the desired flow direction following a re-entrant angle towards the perpendicular to the surface of said work roll and guiding the cooling fluid fluxes tangentially to the work roll, wherein said cooling device comprises a plurality of nozzles through which said cooling fluid jets and scraper fluid jets are projected on said work roll and said cooling device comprises a box fed with a cooling fluid under pressure, provided on one of its external surface with said cooling and scraper fluid nozzles disposed on a curved plate.

2. The rolling mill according to claim 1, wherein said cooling jets are perpendicular to the surface of said work roll.

3. The rolling mill according to claim 1, wherein said cooling fluid jets are arranged in horizontal rows, each adjacent row being laterally shifted so as to form a quincunx disposition.

4. The rolling mill according to claim 1, wherein the exits of said cooling fluid jets are arranged along a curved surface, which curvature radius is higher than the radius of said work roll.

5. The rolling mill according to claim 1, wherein said cooling device is a water pillow cooling device including side guides for forming a water pillow.

6. The rolling mill according to claim 1, wherein said work roll is a bottom work roll.

7. The rolling mill according to claim 1, wherein said work roll is a top work roll.

8. A process of rolling a metallic product the method comprising rolling the metallic product in the rolling mill according to claim 1, wherein said pressure of cooling and scraper fluid jets is lower than 4 bar.

9. The process according to claim 8, wherein said cooling fluid is water.

10. The process according to claim 1, wherein said metallic product is a steel sheet.

11. The process according to claim 1, wherein said rolling mill is a hot rolling mill.

* * * * *